United States Patent [19]

Heron et al.

[11] 4,427,718

[45] Jan. 24, 1984

[54] WEDGE ENCAPSULATION METHOD

[76] Inventors: Patrick Heron, 261 Raymond St., Hillsdale, N.J. 07642; Timothy Hartnett, 415 Beech St., Westwood, N.J. 07675; Adam Wright, 210-25 Jamaica Ave., Jamaica, N.Y. 11428

[21] Appl. No.: 382,393

[22] Filed: May 27, 1982

[51] Int. Cl.[3] ..... B05D 3/12

[52] U.S. Cl. ..... 427/175; 57/295; 427/327

[58] Field of Search ..... 427/175,292, 142, 327; 57/295; 156/48

[56] References Cited

U.S. PATENT DOCUMENTS

| | | | |
|---|---|---|---|
| 1,509,906 | 9/1924 | Sawtelle . | |
| 2,252,755 | 8/1941 | Bruestle | 428/396 X |
| 2,665,773 | 1/1954 | Osmun . | |
| 3,144,916 | 8/1964 | Lien | 184/105 |
| 3,459,156 | 8/1969 | Harter | 118/405 |
| 3,565,213 | 2/1971 | Heller . | |
| 3,607,487 | 9/1971 | Biskeborn et al. | 156/48 X |
| 3,733,216 | 5/1973 | Goldman et al. | 118/405 X |
| 3,783,972 | 1/1974 | Molstad | 184/15 R |
| 3,801,359 | 4/1974 | Polizzano et al. | 118/405 X |
| 3,828,890 | 8/1974 | Schott et al. | 184/15 R |
| 3,885,380 | 5/1975 | Hacker | 156/48 X |
| 3,889,781 | 6/1975 | Schott et al. | 184/15 R |
| 3,916,925 | 11/1975 | Crump | 134/172 |
| 3,951,235 | 3/1974 | Acerbi | 184/15 R |
| 4,022,153 | 5/1977 | Rake et al. | 118/405 X |
| 4,145,153 | 3/1979 | Fasullo et al. | 404/73 |

FOREIGN PATENT DOCUMENTS

| | | |
|---|---|---|
| 257514 | 4/1949 | Switzerland . |
| 531561 | 1/1941 | United Kingdom . |

*Primary Examiner*—Evan K. Lawrence

*Attorney, Agent, or Firm*—Lee C. Robinson, Jr.

[57] ABSTRACT

A method of encapsulating a cable strand formed of a plurality of bundled steel wires is carried out by forcing apart the wires of the strand with wooden wedges, and then filling the resulting gap solid with red lead paste. After this, the wedges are removed to permit the paste to coat and fill all voids between the strand wires. This operation is repeated at a plurality of circumferential positions on the strand. Then, the wedges can be driven in at an adjacent position up the strand. Next, the portion of the strand at which the red lead paste has been so applied is coated with the same paste. Finally, the cable is paint encapsulated by using a bath of red lead paint. This method is favorably carried out to protect the crotch of a suspension bridge main cable strand at a position near the strand shoe thereof.

12 Claims, 13 Drawing Figures

FIG. 7
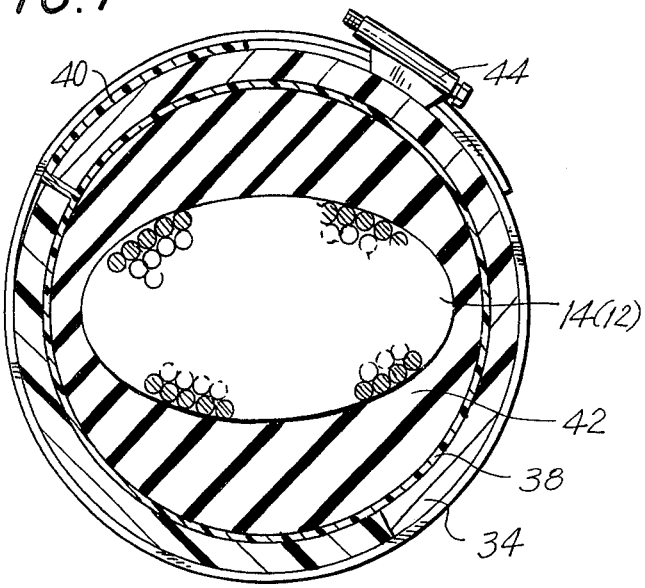
FIG. 8
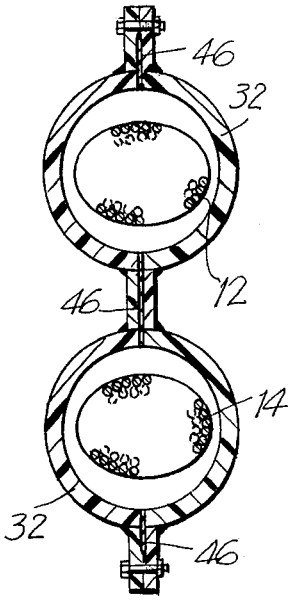
FIG. 9
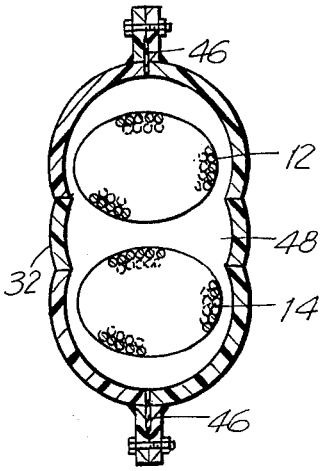
FIG. 10
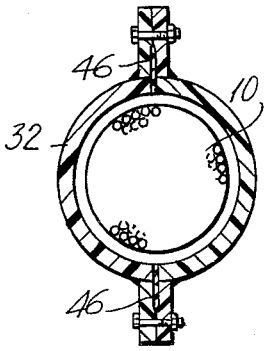
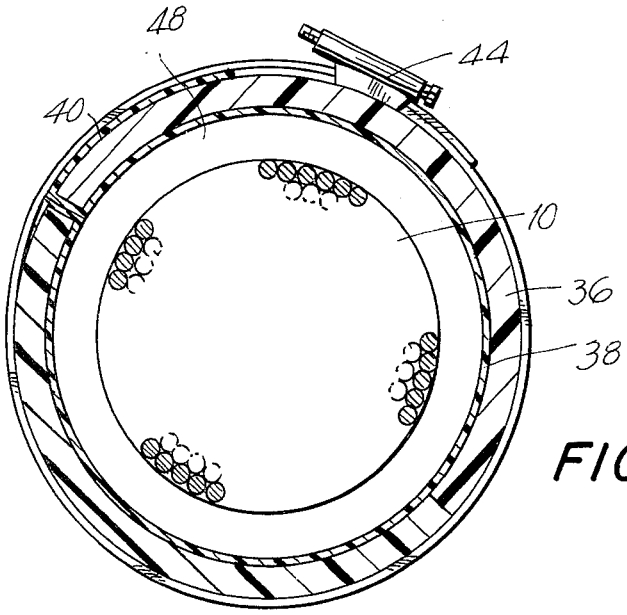
FIG. 11

WEDGE ENCAPSULATION METHOD

BACKGROUND OF THE INVENTION

1. Field of the Invention

This invention relates to corrosion prevention in stress-bearing cable members, for example, cable strands of the main cable of a suspension bridge. This invention is more particularly directed to a method of encapsulation of such cable members, especially where rusting has been a problem, for example, near the crotches of suspension cable wire strands.

2. Brief Description of the Prior Art

Wherever steel wire cables are used, such as in the main cables of suspension bridges, and the cables are exposed to weather, rusting or other corrosion of the cables can occur. The cables are usually coated to help exclude moisture, but water persists in entering the cable just the same. Normally, water will flow to the lowest points of the cable. In the case of the cable strands of the main suspension cables of a bridge, water tends to flow to the vicinity of the cable strand shoes at the shore anchorages, and also tends to flow to the bottom of the main cable catenary. For that reason, the most severe rusting has been detected in those areas.

In addition, suspender ropes or cables extend vertically from the main cables to the suspension bridge deck, and these cables can also experience rusting at the lower ends thereof. Optional cables, such as anti-sway cables, can be included in some suspension bridges and these cables also require protection from rust at their lower portions.

In order to form a plug to prevent rusting of the wires at the lowest ends of the cable members, a paste encapsulation method has been previously proposed. In this previously-proposed method, an anti-rust medium, such as red lead paste, is applied under pressure to the desired sections of the cable members so that the red lead paste or other medium will enter voids in the cable member to form the desired plug.

In order to carry out such method, a steel split pipe, several feet in length is fabricated. Pressure ports are included in the pipe, and rubber gaskets are provided at the ends thereof. The split steel pipe is bolted or clamped in place over the cable member, and the red lead paste is applied at the ports at a nominal pressure of 4500 psi. In theory, pressure forces the red lead paste into the voids between the strand wires. After a sufficient time has passed, the steel pipe is removed and the excess red lead is scraped from the surface of the cable member.

Unfortunately, this previously-proposed encapsulation method has not provided sufficient protection. In fact, when wedges have been driven into a cable member so treated in order to inspect the strand wires within the cable member, it has been found that not all of the wires thereof were coated with the red lead paste. In those wires not coated, rusting had occurred.

Accordingly, an improved method of paste encapsulation has been sought which would be suitable for application to cable members, such as the wire strands of a suspension bridge main cable. However, no suitable such method has been discovered prior to this invention.

OBJECTS AND SUMMARY OF THE INVENTION

One general object of this invention, therefore, is to provide a new and improved method of applying red lead paste, or other anti-corrosive medium, to a multi-wire steel cable member.

More specifically, it is an object of this invention to provide such a method in which the anti-corrosive medium uniformily and thoroughly coats wires of the multi-wire cable member to form a uniform and secure plug therein.

Another object of this invention is to provide a method of the character indicated in which any need to use extreme pressure in application of the anti-corrosive can be avoided.

Still another object of this invention is to provide a method of paste encapsulation which can be carried out without need for heavy, expensive, and complicated construction equipment.

In accordance with an illustrative embodiment of this invention, encapsulation of a cable strand formed of a plurality of bundled steel wires in carried out while the strand is bearing a stress load. At a position in which a plug of protective red lead or other paste is desired, the wires of the strand are forced apart, preferably by driving one or more wedges therebetween, to form a longitudinal gap extending into the interior of the cable strand. Then the protective paste is applied into the resulting longitudinal gap to fill the same. This can be carrid out merely by troweling or gloving the paste into the gap, thereby avoiding any requirement to apply the paste under pressure. When the paste is in place in the gap, the wedges are withdrawn so that the gap is permitted to close on the fill of protective paste. In this way, the paste is urged by radial internal forces in the stressed wires to fill the voids among the wires of the cable strand. The steps of forcing apart the wires, filling the resulting gap, and then permitting the gap to close on the paste, are repeated at several circumferential positions of the cable strand at the location of the desired plug. Thereafter, the portion of the cable strand so treated with protective paste to form the plug is encapsulated. In a preferred embodiment, this involves applying an outer protective coat of the same red lead paste. After such paste encapsulation, a red lead paint encapsulation procedure can be carried out to provide further protection.

It has been discovered that the method of this invention can be carried out most favorably if the wedges used are formed of hardwood, such as ash or hickory. The wedge should have a working length somewhat greater than the maximum diameter of the cable member in question, and should also have a thickness, in the circumferential direction of the cable member, on the order of one-half the diameter of the cable member.

The present invention, as well as further objects and advantages thereof, will be understood more clearly and fully from the ensuing description of a preferred embodiment, when considered in connection with the accompanying drawings.

BRIEF DESCRIPTION OF THE DRAWINGS

FIGS. 7 to 11 are sectional views of portions of the strand of FIG. 6 at planes 7—7 to 11—11, respectively.

DETAILED DESCRIPTION OF A PREFERRED EMBODIMENT

Figure 1:
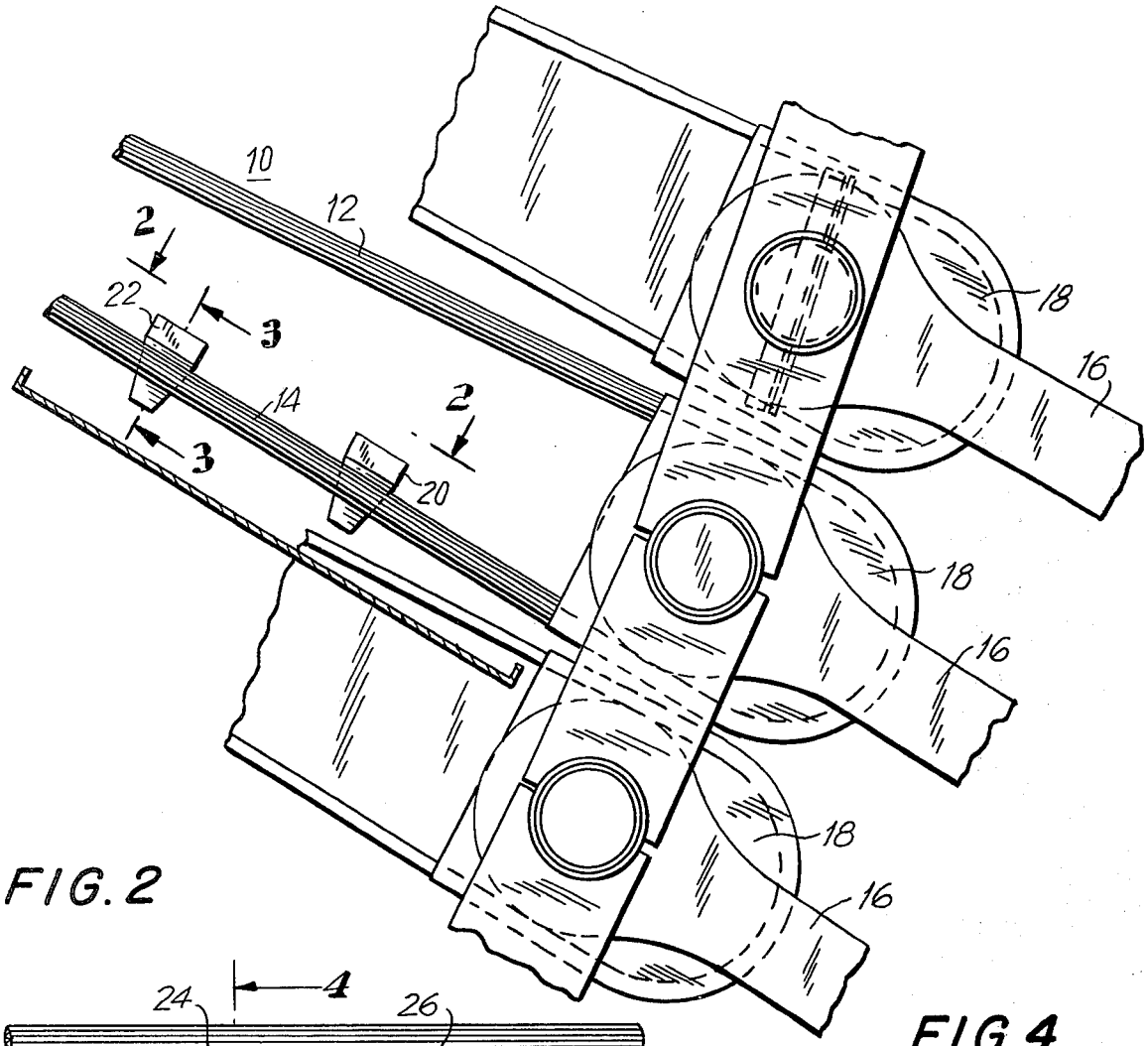
FIG. 1 is an elevational view of the strand-shoe portion of a typical main cable strand, with wedges in place for carrying out the method of this invention.
Figure 2:
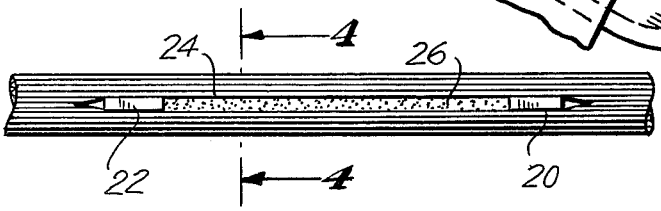
FIG. 2 is a plan view of a portion of one cable strand half, viewed along line 2—2 of FIG. 1.
Figure 4:
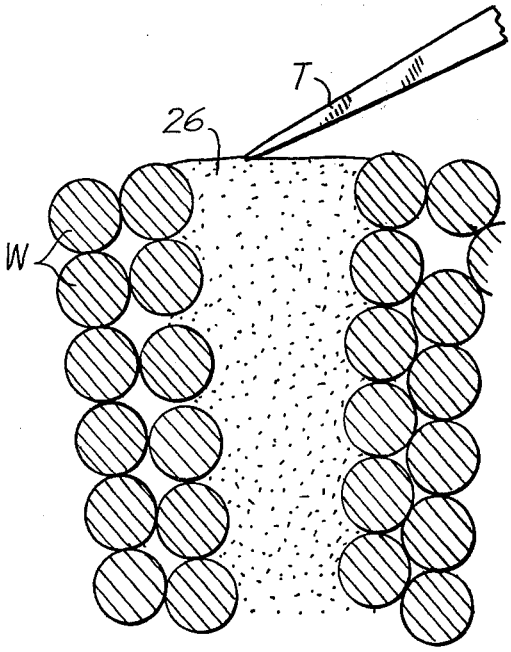
FIG. 4 is a sectional view at the plane 4—4 of FIG. 2 showing anticorrosive paste being laid into a gap in the strand half.

While the present invention has generally universal application in the protection of corrosion of multi-wire cable members, it is particularly suitable for application with the various cables of a suspension bridge.

This invention was first devised for use in protection of suspension bridge main cable strands, particularly at the shore anchorages thereof. The cables illustrated in the accompanying drawing figures are those of the George Washington Bridge, which stretches over the Hudson River between New York, N.Y. and Fort Lee, N.J. That particular bridge has four main cables, each cable consisting of 61 four-and-one-half-inch diameter strands. Each strand is formed of a bundle of 434 steel wires. In addition, a total of 592 suspender cables stretch vertically between the main cables and the bridge deck or roadway.

Because of continued exposure of the various cables to weather, including rainstorms and freezing and thawing cycles, a great deal of moisture has been permitted to enter the cables, despite measures which have been taken to exclude it. This moisture tends to run through voids in the cable strands to the lowest points thereof. In the case of the main cables, the lowest points are at the strand shoes at the shore anchorages, and at the center-span portion of the main cable catenary. Accordingly, at these low points, and particularly at the shore anchorages, a great deal of rusting of the main cable strands has occurred. Thus, the method of this invention is particularly applicable to the paste encapsulation of the cable strands in close proximity to the associated strand shoes, thereby to prevent further corrosion.

Referring first to FIGS. 1–5 of the drawings, a portion of one main cable strand 10 is shown at a portion below the crotch thereof where it is split into two half strands 12 and 14, each consisting of 217 wires (i.e., half the total of 434). At the terminus of the cable strand 10 is an eyebar 16 affixed to the shore anchorage (not shown) and supporting a steel strand shoe 18 over which the strand halves 12, 14 extend.

To begin the paste encapsulation procedure, each strand 10 is water-blasted to remove as much corrosion and rust as possible. Following this, when the strands have dried, wooden wedges 20 and 22 (better shown in FIGS. 12 and 13) are driven into one of the strand halves 12, 14. The wedges here are shown in place in one position of one of the strand halves 14. One of the wedges 20 is driven into the strand half 14 at a minimum distance of about one foot, nine inches from the strand shoe 18, and the other wedge 22 is driven into the cable strand about two feet to two and one-half feet farther up the strand half 14. At these wedges are driven in the same corresponding circumferential positions on the strand half 14, a gap 24 is created between the wedges 20 and 22. This resulting gap 24 is filled with red lead paste 26, which can be applied with a trowel T or, alternatively, with a glove. Then the wedges 20 and 22 are removed, allowing the gap 24 to close over the paste 26, so that the paste is forced by the crushing forces of the wires W themselves to coat the wires and fill any voids therebetween.

Figure 3:
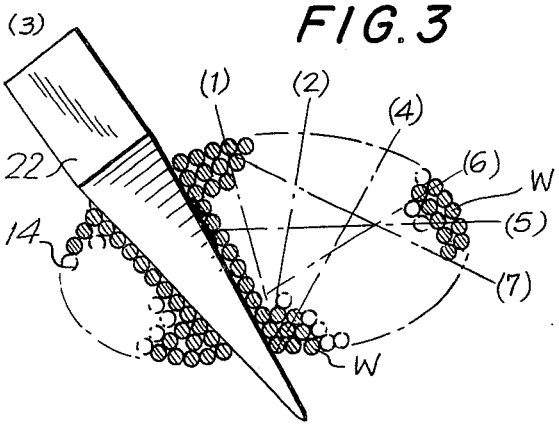
FIG. 3 is a sectional view at the plane 3—3 of FIG. 1.

This operation is repeated as several positions of the strand half 14, i.e., the positions numbered (1) to (7), as shown in FIG. 3. In the drawings, the wedge 22 is shown in the position (3). However, all of the remaining positions would be similar.

After the wedging and pasting procedure has been carried out at each of the seven positions, the wedges are redriven into the cable strand half 14 at a position approximately two feet further up the same. At each of these same seven positions, a gap is formed in the cable strand half 14, the red lead paste 26 is thoroughly applied therein, and the wedges 20, 22 ar removed. Thus, a second, somewhat overcapping plug is formed extending the encapsulated length of the strand half 14 to about four feet.

A similar procedure is, of course, carried out with respect to the upper strand half 12.

It is preferred to dispose a tray 28 below the strand halves 12 and 14 to catch any paste spillage.

Figures 5, 6:
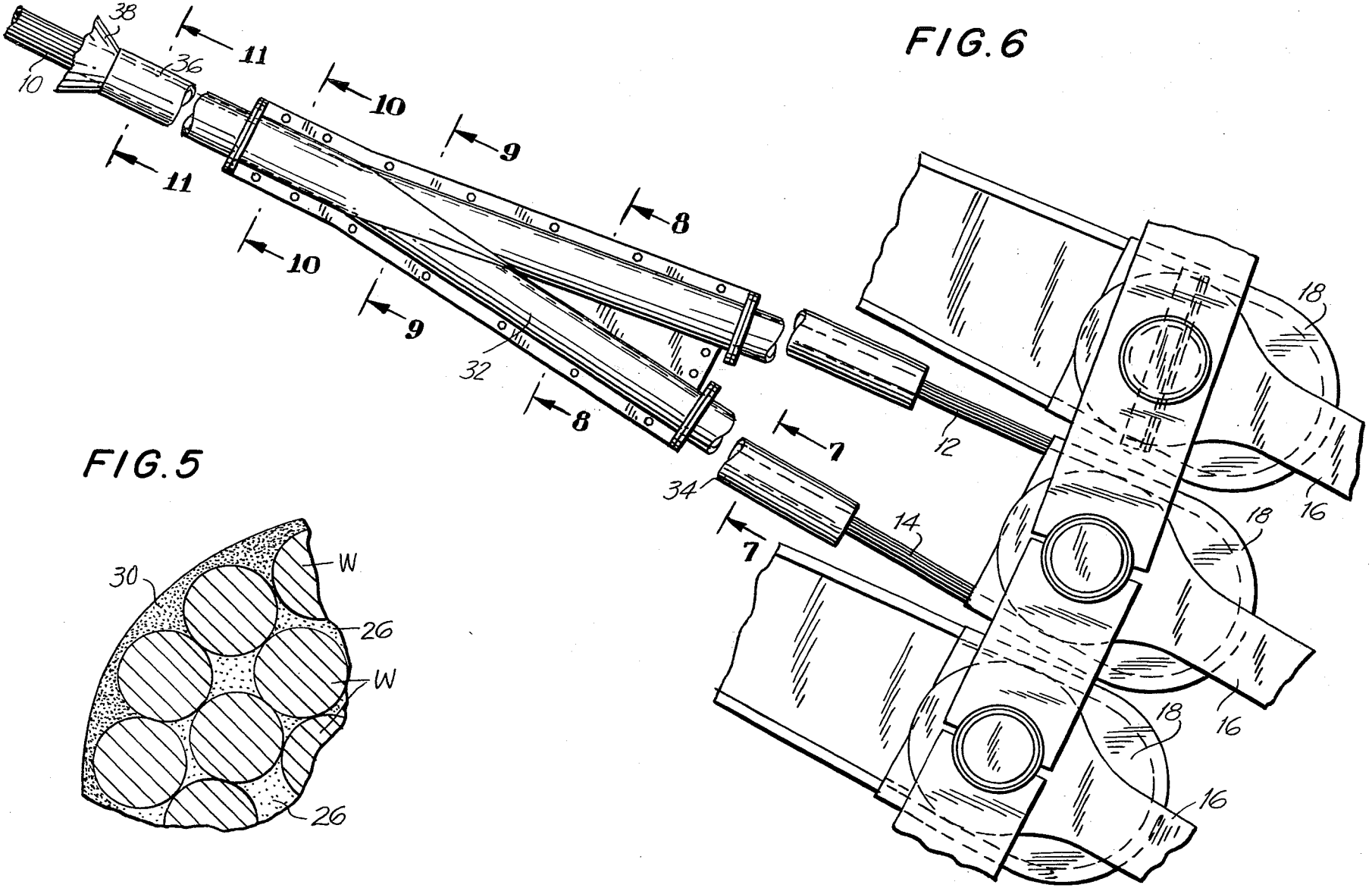
FIG. 5 is a partial sectional view of the strand half of FIG. 4.
FIG. 6 is an elevational view of the cable strand of FIG. 1 at a later stage, with an encapsulation enclosure in place thereover.

After the above steps have been carried out, a coating 30 of the same red lead paste is applied over the wires W of each strand half 12, 14 (FIG. 5). This paste coating 30 provides a solid base for application of a polyvinyl chloride (PVC) heat sealable plastic sleeve and prevents red lead paint from running out or leaking during an ensuing paint encapsulation portion of the method of this invention.

As best shown in FIG. 6, and as also shown in cross section in FIGS. 7–11, a wye 32 formed of a split and flanged pipe is bolted in place over the crotch, or splice of the strand halves 12 and 14. A pair of PVC pipes 34 are connected by flanged connectors to the wye 32 and extend toward the shoe 18 at least over the portion of each strand half 12, 14 which has received the above wedge paste encapsulation treatment. A similar PVC pipe 36 is provided extending upward from the crotch over the cable strand 10.

A full-length continuous heat-sealable plastic sheet extends within the wye 32 and also within the pipes 34 and 36 to assist in sealing the same. As shown in FIGS. 7 and 11, a lap 40 of approximately three inches is formed of the plastic sheet 38. This lap 40 extends through the splits in the respective pipes 34, 36 and is heat-sealed. Steel hose clamps 44 are provided over the pipes 34, 36 to hold the same firmly in place over the respective portions of the strand 10.

Alternatively, the sealing can be carried out by use of self-adhesive neoprene about $\frac{1}{8}''$ thick on opposing edges of the pipes 34 and 36. When the pipes are then bolted in place, the neoprene forms a substantially secure seal. In this case, the neoprene should be replaced after each use.

Compressible gaskets 46 (FIG. 7) are provided at the ends of the pipes 34, 36 and at flanges of the wye 32 to prevent red lead paint from seeping out therefrom. As an alternative to the gaskets 46, it is possible to use styrofoam board cut oversize in combination with duct seal and neoprene, all held in place with C-claims. A clearance 48 is formed within the enclosure constituted by the wye 32 and pipes 34, 36. Spacers (not shown) are provided for this purpose. Also not shown are an inlet on the pipe 36 and paint drain spigots on the pipes 34.

Once in place, the structue constituted by the wye 32 and the pipes 34, 36 is filled with red lead paint. Then the paint is allowed to remain in contact with the crotch portion of the strand 10 for a sufficient length of time to provide the requisite amount of rust protection. The paint can be applied under a moderate amount of pressure, but does not need to be so applied and can be applied without additional pressure.

Figure 12:
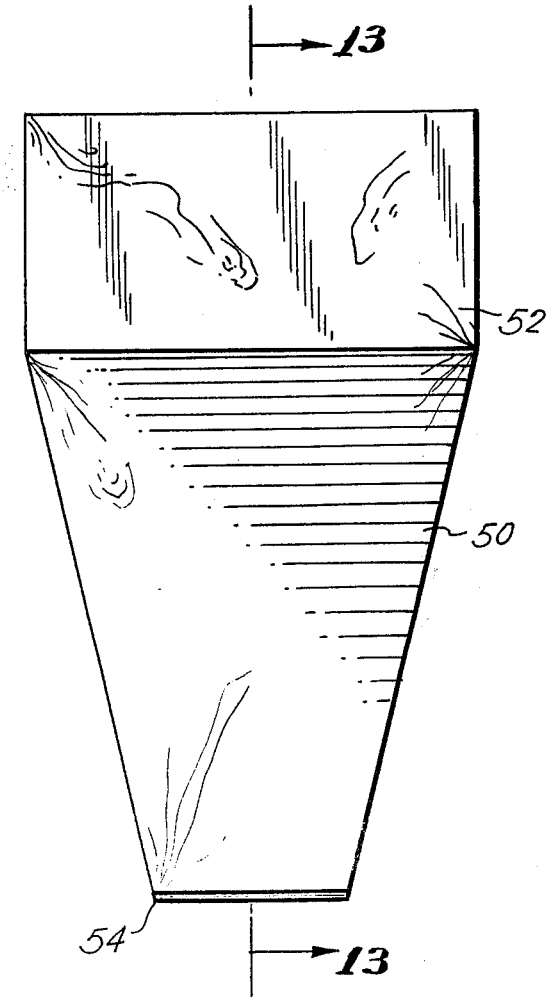
FIGS. 12 and 13 are front elevation and longitudinal sectional views, respectively, of a wedge used in carrying out this invention.
Figure 13:
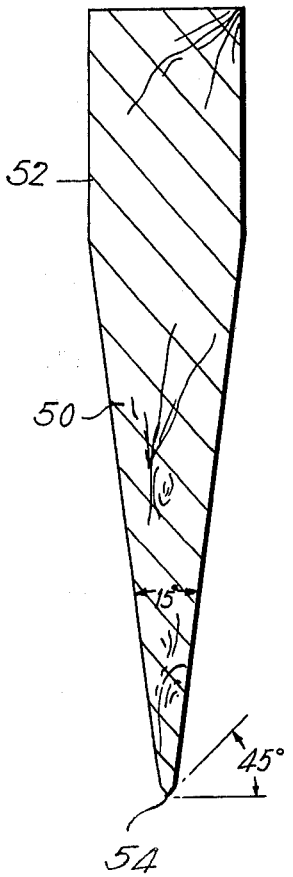

As shown in FIGS. 12 and 13, the wedges 20 and 22 are each preferably formed of a material which is firm and resilient enough that it can be used for spreading the wires W of each strand half 12, 14, but is also soft enough that it will not scratch or damage any of the wires W. For this reason, it has been found that hardwood, preferably white ash or hickory, is highly suited for use as the wedges 20, 22. These wedges can be easily sharpened and sanded smooth for use in the method of this invention.

The wedges 22 and 24 each have a tapered nose or spreader section 50, in this embodiment about seven and one-half inches in length. As shown in FIG. 13, the faces of the spreader section are angled at one another at about fifteen degrees. As will be recalled from the previous discussion, the cable strands 10 each have a diameter of about four and one-half inches. Thus, each of the strand halves 12, 14 also has a maximum diameter of about four and one-half inches. Consequently, the length of the spreader section is somewhat greater than the maximum diameter of the respective strand halves 12 and 14.

The wedge also has a flattened rear section 52 approximately two inches thick, six inches wide and three inches in breadth. Thus, this rear portion 52 has a thickness, that is, a dimension in the circumferential direction of the strand halves 12, 14, on the order of about one-half the maximum diameter of the respective strand halves 12 and 14.

An edge portion 54 is formed at the tip of the spreader section 50, and each face thereof is cut at approximately a 45° angle with respect to the lengthwise direction of the wedge. As a result, the edge portion 54 has a cutting angle of about 90°. This facilitates sharpening of the edge portion 54, and provides optimum safe penetration between the wires W of each strand half 12, 14.

While the method of the above invention is illustrated by a particular embodiment applied to the shore terminus of a main cable strand 10, it should be apparent that this method could be easily adapted for use with any stress bearing cable, including optional anti-sway cables, and the catenary portion of the main cables of a suspension bridge. The invention can also be applied to the suspender ropes, in some cases, although, at least in the case of the George Washington Bridge, the suspender ropes are under such tension that it is difficult to drive in the wedges, and provisions would be required for partially detensioning the suspender ropes. The method of this invention could also be favorably applied in many other environments where a cable is installed in place for an extended period. Such environments could include, for example, multi-pair telephone cables, or dry land structures, such as guy cables of radio masts.

Other applications for the method of this invention will suggest themselves to those skilled in the art upon a perusal of the foregoing disclosure.

The terms and expressions which have been employed hereinabove are intended as terms of description and not of limitation, and there is no intention, in the use of such terms and expressions, of excluding any equivalents of the features shown and described, or portions thereof, it being recognized that various modifications are possible without departure from the spirit or scope of this invention which is to be determined from the appended claims.

What is claimed is:

1. A method of in-place encapsulation of a stressed structure-supporting cable strand formed of a plurality of bundled steel wires while the strand is bearing a stress load, comprising forcing apart the wires of said strand to form a longitudinal gap extending into the interior of said cable strand, then filling such longitudinal gap with a protective paste, permitting the gap to close on said filled protective paste, so that said paste is urged by forces in the stressed wires to fill voids among the wires of the cable strand, and providing, around at least the portion of the cable strand so treated with protective paste, encapsulating means to seal such portion from corrosive agents.

2. A method of encapsulating a cable strand formed of a plurality of bundled wires comprising driving at least one wedge radially into the cable strand thereby creating a gap extending radially into the interior of said cable strand, filling the resulting said gap with an anticorrosive paste, extracting said at least one wedge thereby permitting said gap to close around said paste, and providing encapsulating means around at least the paste-treated portion of the cable strand to seal the same from corrosive agents.

3. A method of encapsulating a cable strand formed of a plurality of bundled wires comprising driving at least one wedge radially into the cable strand thereby creating the gap extending radially into the interior of the cable strand, filling the resulting said gap with an anticorrosive paste, extracting the at least one wedge thereby permitting said gap to close around said paste, at a plurality of circumferentially spaced positions on said cable strand, repeating the above steps of driving said at least one wedge, filling the resulting gap, and extracting said wedge, and providing encapsulating means around at least the paste-treated portion of the cable strand to seal the same from corrosive agents.

4. A method of encapsulating a cable strand formed of a plurality of bundled wires comprising driving a pair of wedges into said cable strand at respective locations thereon circumferentially corresponding to each other but axially spaced from one another, thereby creating a gap between said wedges and extending into the interior of said cable strand;

filling the resulting said gap with an anticorrosive paste;

extracting said wedges thereby permitting said gap to close around said paste; and providing encapsulating means around at least the paste-treated portion of the cable strand to seal the same from corrosive agents.

5. A method of encapsulating a cable strand formed of a plurality of bundled wires comprising driving a pair of wedges into said cable strand at respective locations thereon circumferentially corresponding to each other but axially spaced from one another, thereby creating a gap between said wedges and extending into the interior of said cable strand;

filling the resulting said gap with an anticorrosive paste;

extracting said wedges thereby permitting said gap to close around said paste;

at a plurality of circumferentially spaced positions on said cable strand, repeating the above steps of driving said wedges, filling the resulting gap with said paste, and extracting said wedges, thus ensuring that said paste enters substantially all voids in the cable strand; and providing encapsulating means around at least the paste-treated portion of the cable strand to seal the same from corrosive agents.

6. A method of encapsulating a cable strand formed of a plurality of bundled wires comprising driving a pair of wedges into said cable strand at respective locations thereon circumferentially corresponding to each other but axially spaced from one another, thereby creating a gap between said wedges and extending into the interior of the cable strand, filling the resulting said gap with an anticorrosive paste;

extracting said wedges thereby permitting said gap to close around said paste;

at a plurality of circumferentially spaced positions at substantially the same axial location, repeating the steps of driving said wedges, filling said resulting gap, and extracting the wedges;

at at least one other axially closely spaced location on said cable strand, at a corresponding plurality of circumferentially spaced positions thereon, again repeating the steps of driving said wedges, filling said resulting gap, and extracting the wedges; and providing encapsulating means around at least the paste-treated portion of the cable strand to seal the same from corrosive agents.

7. A method of encapsulating a cable strand formed of a plurality of bundled steel wires, the strand having a predetermined maximum thickness, comprising driving radially into the cable strand, at respective circumferentially corresponding, axially spaced locations, a pair of hardwood wedges, each having, in the direction of insertion into the strand, a tapered forward portion and a flat rear portion, the tapered forward portion being longer than the predetermined maximum cable strand thickness, and the flat rear portion having a thickness, in the circumferential direction of said cable strand, on the order of one half said maximum cable strand thickness, thereby creating a longitudinal gap between said wedges;

filling the resulting longitudinal gap with a protective paste; and extracting said wedges, thereby permitting said gap to close against said paste so that said paste is driven by radial forces within the cable strand to enter voids within the same.

8. A method of encapsulating a cable strand according to claim 7, wherein said hardwood is selected from the group consisting of ash and hickory.

9. A method of encapsulating a cable strand according to claim 7, wherein said tapered section has a spreader portion having circumferentially opposite faces angled at an acute angle, and a wedge point portion with a substantially right-angle biting edge.

10. A method of encapsulating a portion of a cable strand of a suspension bridge cable, the cable strand being split into two half strands from a point on the strand to extend around a supporting strand shoe, each half strand being formed of a bundle of steel strand wires; comprising driving a pair of wedges into said cable strand at respective circumferentially corresponding axially spaced locations, with one of said wedges being one predetermined distance from said shoe, the other wedge being driven into said cable strand remote from said shoe another predetermined distance from said first wedge, so that a longitudinal gap is created extending into the interior of said cable strand;

applying a red lead paste into the gap;

extracting said wedges, thereby permitting said gap to close around said paste;

repeating the steps of driving in said wedges, applying said paste, and extracting said wedges at a plurality of circumferential positions on each said cable strand half with said one wedge at said one predetermined distance from said shoe, and at a corresponding plurality of circumferential positions on each said cable strand half with said one wedge at a distance approximately said other predetermined distance beyond said one predetermined distance from said shoe;

coating with red lead paste the exterior of each said cable strand half at least at the portions thereof at which such paste was applied into said gaps; and covering at least said paste coated portions with a sealant layer.

11. A method of encapsulating a portion of a cable strand of a suspension bridge at a shore anchorge thereof, the cable strand being split into two half strands from a point on the strand to extend around a supporting strand shoe, each half strand being formed of a bundle of steel wires; comprising forming a longitudinal gap at a circumferential position on one said half strand by forcing the wires thereof apart at said position, then filling the resulting longitudinal gap with a protective paste, permitting the filled gap to close under internal forces between the wires of the half strand, repeating the steps of forming a longitudinal gap, filling the resulting gap, and permitting the filled gap to close, at a plurality of circumferential further positions in said one cable half strand and also at a corresponding plurality of such positions in the other cable half strand;

coating with a layer of said paste at least the portions of said cable half strand at which said protective paste has been filled in said gaps; and covering at least the coated portions of said half strands with a sealant layer.

12. A method of in-place encapsulation of a stressed structure-supporting cable strand formed of a plurality of bundled steel wires while the strand is bearing a stress load, comprising deforming the cable strand while the strand is bearing its stress load to expose an interior portion of the strand;

then filling the exposed interior portion of the strand with a protective medium;

permitting the strand so filled with protective medium to be restored under said stress load so that said protective medium is urged by forces in the stressed wires of the strand to fill voids among the wires of the cable strand; and providing, around at least the portion of the cable strand so treated with said protective medium, encapsulating means to seal such portion from corrosive agents.

* * * * *